United States Patent [19]

Sidney

[11] Patent Number: 4,503,571

[45] Date of Patent: Mar. 12, 1985

[54] INFANT TRAINER SEAT

[76] Inventor: James T. Sidney, 1105 Wentworth Ave., Box 864, Chicago Heights, Ill. 60411

[21] Appl. No.: 459,798

[22] Filed: Jan. 21, 1983

[51] Int. Cl.[3] ..... E03D 11/00; A47K 13/00

[52] U.S. Cl. ..... 4/254; 4/239; 4/573

[58] Field of Search ..... 4/238, 239, 254, 571, 4/572, 573; 119/1

[56] References Cited

U.S. PATENT DOCUMENTS

| | | | |
|---|---|---|---|
| 1,089,040 | 3/1914 | Block | 4/239 |
| 1,722,524 | 7/1929 | Lmmele | 4/239 |
| 1,998,854 | 4/1935 | Steele et al. | 4/239 |
| 2,104,653 | 1/1938 | Johnson | 4/239 |
| 2,415,237 | 2/1947 | Dunn et al. | 4/239 |
| 3,209,376 | 10/1965 | Drury, Jr. | 4/239 X |

*Primary Examiner*—Henry K. Artis

*Attorney, Agent, or Firm*—Ronald A. Sandler; Jerry A. Schulman

[57] ABSTRACT

This invention relates to an infant trainer seat for releasable mounting to a standard commode or toilet seat. The trainer seat includes a tubular support frame and cross-members adapted to rest on the standard seat, span the opening of the standard seat and releasably grasp the standard seat. The trainer seat portion defines a child-receiving opening and is secured to the support frame with the opening positioned on the frame for alignment with the opening in the standard seat. A collapsible backrest system is provided which includes a backrest portion that is movable between a raised upright position and a collapsed coplanar position. The backrest system includes a frame mechanism for pivotally connecting the backrest to the main support frame and positioning the backrest in the upright or the co-planar positions. An armrest and infant-restraining frame is also provided and is pivotally connected to the backrest frame for movement from a substantially upright position aligned with the backrest to a substantially horizontal position aligned with the support frame.

The backrest frame includes overcenter toggle linkage means for pivotally connecting the support frame and backrest. The armrest is spring-biased toward an upright position. Latch means are provided for latchably securing the trainer seat to the standard seat or commode.

1 Claim, 6 Drawing Figures

INFANT TRAINER SEAT

BACKGROUND OF THE INVENTION

This invention relates to infant training seats, and more particularly, to a type of seat that mounts to a standard toilet or commode.

Numerous patents have issued in this field and are generally found in U.S. Patent and Trademark Office classification system at Class 4, Subclasses 238, 239 and at Class 119, Subclass 1. Exemplary patents include U.S. Pat. Nos. 1,998,854; 1,089,040; and 4,271,544.

It is the object of this invention to provide an improved infant training seat which is: comfortable for the infant to use; safe for the infant to use in that he is comfortably restrained to stay on the trainer seat while the seat is in position on the standard toilet seat; collapsible for ready storage; and convenient to use.

This and other objects of this invention will become apparent from the following description and appended claims.

SUMMARY OF THE INVENTION

There is provided by this invention an infant trainer seat for releasable mounting to a standard commode or toilet seat. The trainer seat includes a tubular support frame adapted to rest on a standard seat, span the opening in the standard seat and releasably grasp the standard seat. The trainer seat portion which defines a child-receiving opening is secured to the support frame and is positioned on the frame to be aligned with the opening in the standard seat. A collapsible backrest system is provided which includes a backrest portion that is movable between the raised upright position and a lowered co-planar storage position. This system also includes backrest frame means which are pivotally connected to the support frame and backrest for positioning the backrest in the upright co-planar position. An armrest and infant-restraining frame means is pivotally connected to the backrest frame for movement from a substantially upright position aligned with the backrest to a substantially horizontal position aligned with the support frame but spaced therefrom.

DESCRIPTION OF THE PREFERRED EMBODIMENT

Figure 1:
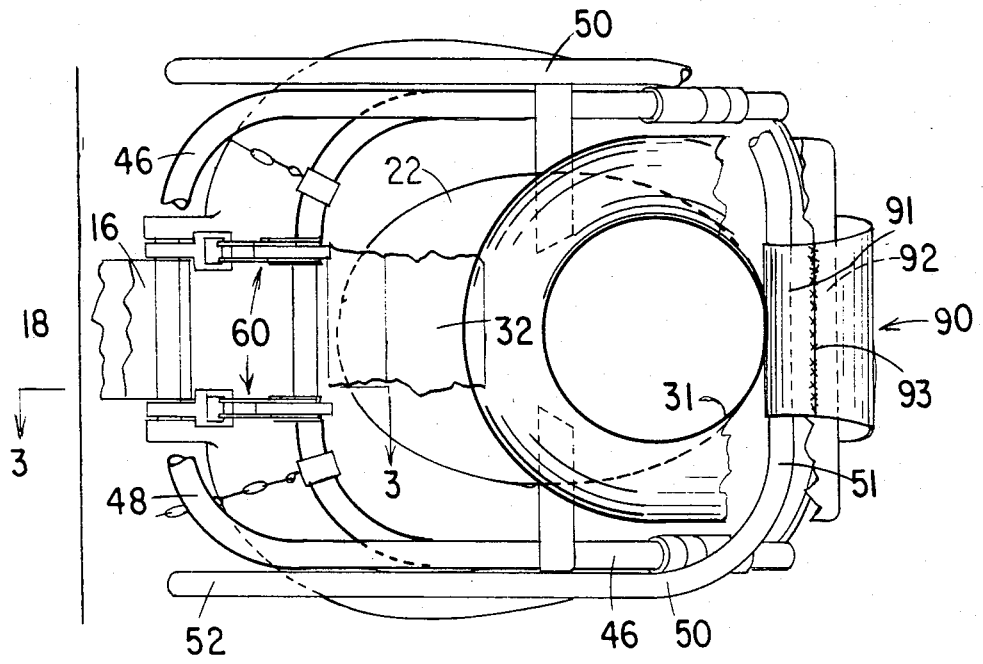
FIG. 1 is a top plan view showing the trainer seat mounted on a standard commode or toilet seat.
Figure 2:
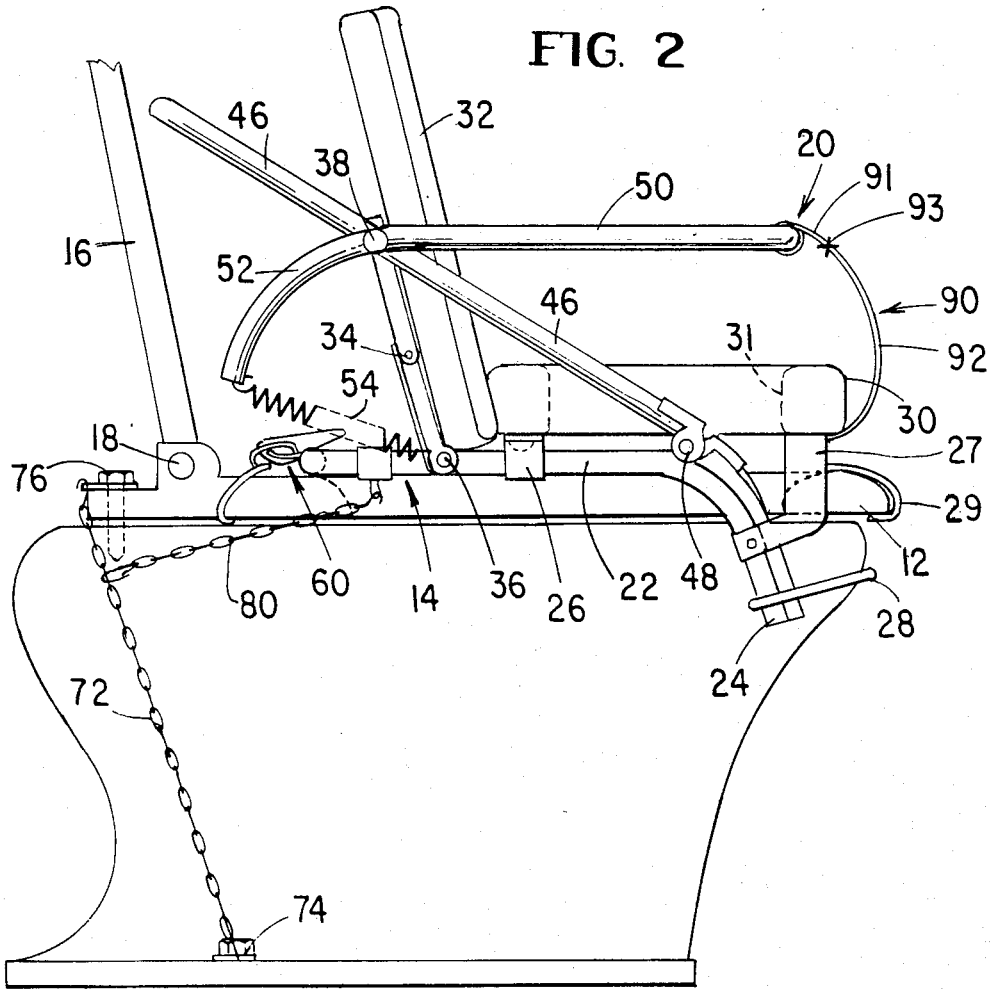
FIG. 2 is a side view showing the trainer seat mounted on the standard toilet seat.

Referring now to the drawings, and in particular FIG. 2, there is shown a commode 10 onto which a standard toilet seat 12 is secured. The toilet seat 12 defines a standard opening 14 and includes a cover 16 which is pivotally secured at pin 18 to the seat.

The infant seat assembly 20 generally is shown mounted to the toilet seat 12. The infant seat includes a forwardly opening tubular metal support frame 22 with downturned forward leg portions 24. Cross-members 26 and 27 provide a seat support and are secured to either side of the support frame 22 intermediate its ends. A commode grasping rail 28 is secured to the lower ends of each of the depending legs 24, and a latch system 29 generally is provided at the rearward or bight portion of the support frame for latching the frame 22 to the toilet seat 12. Secured to the forward edges of support member 27 are a pair of sleeves 29 and **29*a* which slide over and engage the frontal surfaces of toilet seat 12**.

The infant seat 30 is secured to the cross-members 26 and 27 and is arranged to be positioned at the forward edge of the toilet seat 12, with the sleeves 29 and **29*a* engaging the seat. The infant seat 30 defines a child-receiving opening 31 which is aligned with the forward end of the opening 14 in the standard seat. The seat 30** is padded for the child's comfort.

Figure 6:
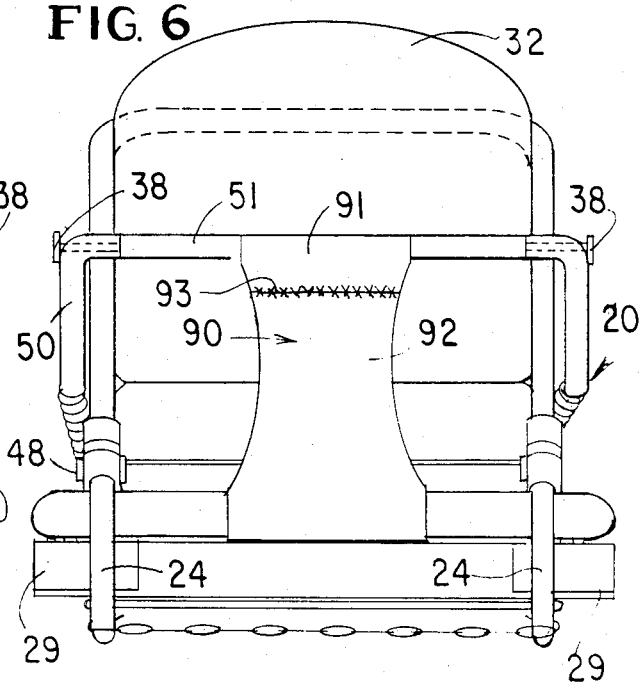
FIG. 6 is a rear view of the seat.

The seat assembly 20 also includes a backrest system which includes a padded backrest member 32 and a support frame system. The backrest member 32 is movable between an upright position where the child can rest against it and a collapsed position substantially co-planar with the seat 30 for storage. The backrest 32 is secured to a pair of toggle-type linkages such as 34. The linkages are secured at their lower end to the support frame 22 at a pivot point 36. The linkage is secured at its upper end to a pivot point 38 which is, in turn, part of the tubular member which extends transversely of the seat for supporting the backrest and to which the backrest is connected. This connection is best seen in FIG. 6 in which the transverse connecting bar 40 is shown connected to the backrest 32 by a pair of screws 42 and 44. The linkages, such as 34, include upper and lower members which are pivotally connected at their center to provide a collapsible linkage as shown, for example, in FIG. 4. When snapped into the overcenter position, this linkage locks the backrest system 32 into the upright position. The backrest also may be provided with an appropriate latch (not shown) to lock member 32 in the upright position.

The backrest support system also includes a U-shaped tubular-metal rigidifying member 46. The U-shaped member 46 opens forwardly and is connected at each of its ends to a hinge member, such as 48, that permits pivoting of the member 46 and the hinge members, such as 48, are connected to the support frame 22. The rigidifying member 46 is also connected to the linkage system 34 and backrest 32 at the pivot point 38. Thus the linkage 34 and rigidifying member 46 provide a stabilizing and locking system for assuring the upright positioning of the backrest 32.

In addition, there is provided an armrest and child-restraining frame 50 which is a U-shaped tubular metal member which opens rearwardly. The member 50 is pivotally secured at pivot point 38 so as to be movable between an upright position so that the child can be placed on the seat and a lowered position where the child is safely and comfortably restrained on the seat. The restraining arm 50 includes depending rearward portions, such as 52, each of which are connected to a biasing tension spring 54 which, in turn, connect to pivot points 36. The springs 54 are selected so as to prevent the child who is in the seat from pushing the restraining bar 30 downwardly which would permit him to leave the seat. The backrest also may be provided with a body harness (not shown) to releasably secure the child in position on the seat 20. Interconnecting the front of seat 30 and the bight portion 51 of member 50 is a safety web 90 having upper and lower portions 91 and 92 releasably connected by a zipper 93. The web 90 prevents a child from accidentally sliding forward out of the seat.

Figure 3:
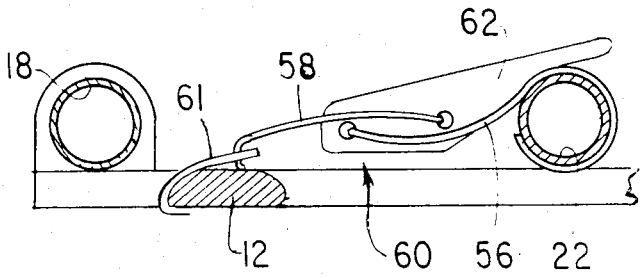
FIG. 3 is a sectional view taken along line 3—3 of FIG. 1 showing a toggle arrangement for the latch arrangement that secures the infant trainer seat to the toilet seat.

The latching system 60 for securing the trainer seat to the commode seat includes a pair of toggle-like mechanisms of the type shown in FIG. 3, which are provided for connecting the bight portion of the support frame 22 to the back of the standard seat 12. The toggle includes metal links 56, 58 and 61, which are constructed to connect the seat frame and hinge. A toggle latch 62 is provided with pivotal connections to the metal members 56 and 58, and when actuated by pulling to an overcenter position, applies tension and locks the infant seat to the commode seat 12. The combination of the toggle system 60 and front rail 28 secures the seat in position.

As an additional safety arrangement, two chains 70 and 72 may be positioned to extend between the commode securing nuts, such as 74, and the seat securing nuts, such as 76, by means of washers 77. A pair of side chains 78 and 80, each having spring clips 81 are also provided for releasably and adjustably securing the trainer seat 20 to the respective chains 70, 72.

Figure 4:
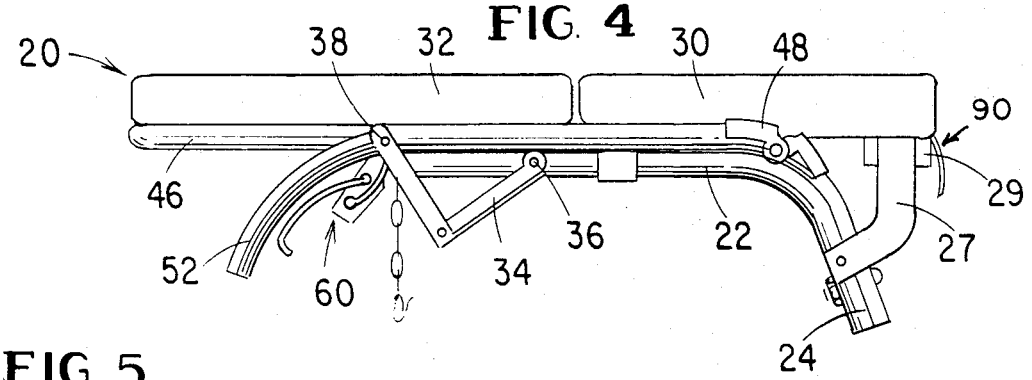
FIG. 4 is a side view showing the seat in a collapsed position.
Figure 5:
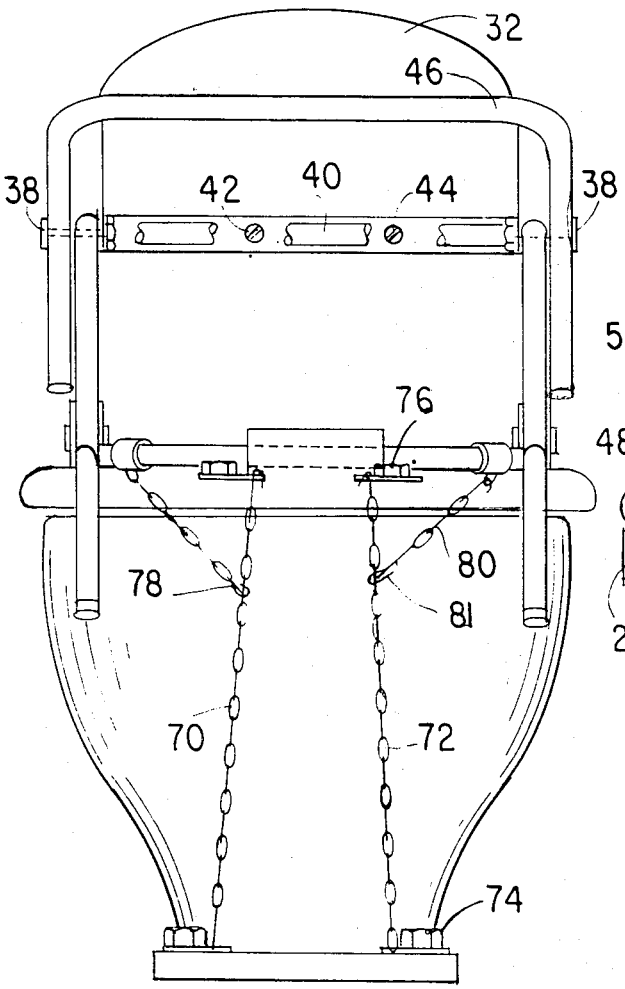
FIG. 5 is a front view of the seat.

When it is desired to store the seat as shown in FIG. 4, the linkage 34 is opened and the frame 46 is drawn to a downward position parallel to the frame 22. In this position, the backrest 32 is co-planar or lies in the plane as the child's seat portion 30.

In order to use the seat, the backrest is raised to the upper position by raising the frame 46 and latching the toggle linkages 34. The seat then is positioned on the main toilet seat or commode 12 with the rail 28 engaging the front edge of the commode and the sleeves 29 and **29*a* engaging the seat 12. Thereafter, the latch system 29 is engaged so as to securely lock the support frame and seat to the main toilet seat. Thereafter, the child is placed on the seat and the arm 50 is drawn downwardly, and the portions 91 and 92 of web 90** are zippered together, all to safely restrain the child.

It will be appreciated that numerous changes and modifications can be made to the embodiment shown herein without departing from the spirit and scope of this invention.

What is claimed and desired to be secured by Letters Patent of the United States is:

1. An infant trainer seat for releasable mounting to a standard commode or toilet seat, said trainer seat comprising:

a. a support frame system adapted to rest on a standard seat, span the opening in the toilet seat and releasably grasp the toilet seat;

b. a trainer seat portion which defines a child-receiving opening secured to said frame and positioned on said frame to be aligned with the opening in said standard seat;

c. a collapsible backrest system which includes (1) a backrest portion that is movable between a raised substantially upright position and a collapsed co-planar position; and (ii) backrest frame means pivotally connected to said support frame and backrest, for positioning and securing the backrest in either the upright or co-planar positions;

d. armrest and infant-restraining frame means pivotally connected to said backrest frame means for movement from a substantially upright position aligned with the backrest to a substantially horizontal child-restraining position aligned with the support frame but spaced therefrom;

e. said backrest frame means further including overcenter toggle linkage means for pivotally connecting said support frame and said backrest which is in a closed position when the seat is upright and in an opened position when collapsed, and tubular means pivotally connected at one end to the support frame adjacent the forward end of the infant seat and pivotally connected to the toggle linkage adjacent the backrest;

f. spring-biasing means are provided for biasing the armrest frame means to the upright position, said biasing means comprising a tension spring connecting the rearward and lower ends of the armrest frame means and the support frame means; and g. latch means operatively associated with said support frame system are provided for latchably and releasably connecting said trainer seat to said standard seat.

* * * * *